United States Patent [19]

Grimm et al.

[11] 4,388,913

[45] Jun. 21, 1983

[54] ADJUSTMENT DEVICE FOR ROTARY ANGLE ADJUSTMENT

[75] Inventors: Gerold Grimm, Leonberg; Klaus Rose, Mundelsheim; Ulrich Kemmner; Rainer Schillinger, both of Stuttgart; Alois Stemmer, Vaihingen, all of Fed. Rep. of Germany

[73] Assignee: Robert Bosch GmbH, Stuttgart, Fed. Rep. of Germany

[21] Appl. No.: 217,354

[22] Filed: Dec. 17, 1980

[30] Foreign Application Priority Data

Jan. 17, 1980 [DE] Fed. Rep. of Germany ..... 3001473

[51] Int. Cl.[3] ..... F02M 23/04

[52] U.S. Cl. ..... 123/585; 123/339; 123/588; 251/133; 251/335 A

[58] Field of Search ..... 123/327, 339, 585–589; 251/309, 335 A, 133

[56] References Cited

U.S. PATENT DOCUMENTS 2,757,898 8/1956 Cox ..... 251/335 A
3,347,516 10/1967 Linde ..... 251/309
3,484,079 12/1969 Reagan ..... 251/309
4,084,563 4/1978 Hattori et al. ..... 123/586 X
4,215,847 8/1980 Hoos ..... 251/309 X

FOREIGN PATENT DOCUMENTS 55-51928 4/1980 Japan ..... 123/585

*Primary Examiner*—William A. Cuchlinski, Jr.
*Attorney, Agent, or Firm*—Edwin E. Greigg

[57] ABSTRACT

An adjustment device having a servomotor and arranged for rotary angle adjustment is proposed. The rotary portion is connected via a shaft with a throttle device which controls the cross section of a bypass line bypassing a throttle valve disposed in the intake tube of an internal combustion engine. The adjustment device is axially limited on one end by a cap, which is embodied as a cast part together with a portion of the bypass line. The throttle device is embodied as a rotary slide and with a control portion transversely penetrates the cap and the bypass with the control portion arranged to open the bypass to a greater or lesser extent depending on the position of the rotary slide. Between an armature of the servomotor and the rotary slide, a sealing disc is loosely guided on the shaft. As a result of a pressure drop at the sealing disc, the sealing disc can be pressed against a sealing face of the cap in order to keep the leakage air quantity as small as possible.

3 Claims, 3 Drawing Figures

ADJUSTMENT DEVICE FOR ROTARY ANGLE ADJUSTMENT

BACKGROUND OF THE INVENTION

The invention is based on an adjustment device of the type described by the preamble to the main claim. Adjustment devices of this kind, in known forms of embodiment, are realized as reversable electromotors having a subsequent gear drive and a potentiometer for the detection of the adjustment angle as a feedback value for a followup amplifier, which furnishes the supply voltage for the electromotor. If a throttle device in a bypass around the throttle valve of an internal combustion engine is to be adjusted with an adjustment device of this kind, for instance to effect closed-loop control of the idling rpm of the engine, then at the present time not only are strict demands placed on the electric/electronic portion of the adjustment device but the control of the bypass cross section must be made as precise as possible, because regulations concerning exhaust composition are becoming more and more stringent and the need to conserve fuel is ever more apparent.

OBJECT AND SUMMARY OF THE INVENTION

The adjustment device according to the invention having the characteristics of the main claim has the advantage over the prior art that a very precise control can be attained for the cross section of the bypass.

As a result of the characteristic disclosed in the dependent claim, an advantageous modification of and improvement to the adjustment device disclosed in the main claim can be attained. As a result, the infiltrated-air component is kept as small as possible by simple means.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
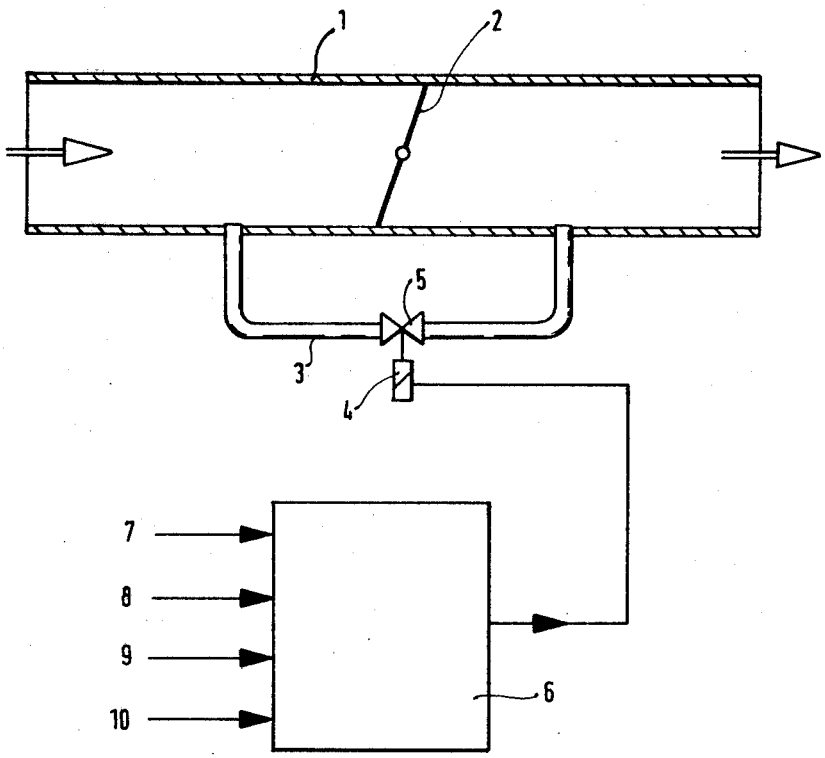
FIG. 1 shows in schematic form an adjustment device disposed in a bypass around the throttle valve in the intake tube of an internal combustion engine.

In FIG. 1, air for combustion flows in the direction of the arrow through an intake tube 1 past a throttle valve 2 to an internal combustion engine, not shown. A bypass line 3 communicates with the intake tube 1, bypassing the throttle valve 2; the passageway cross section of this bypass line 3 is variable by means of an adjustment device 4, which actuates a throttle device 5. The adjustment device 4 is triggered by an electronic control device 6 having various inputs applied at the following locations: the supply voltage is applied at 7; the signal for the rpm, which is picked up by the ignition distributor, is applied at 8; the signal for the engine temperature is applied at 9; and a voltage characterizing the position of the throttle valve 2, supplied for example by a potentiometer connected to the throttle valve 2, is applied at 10.

Figure 2:
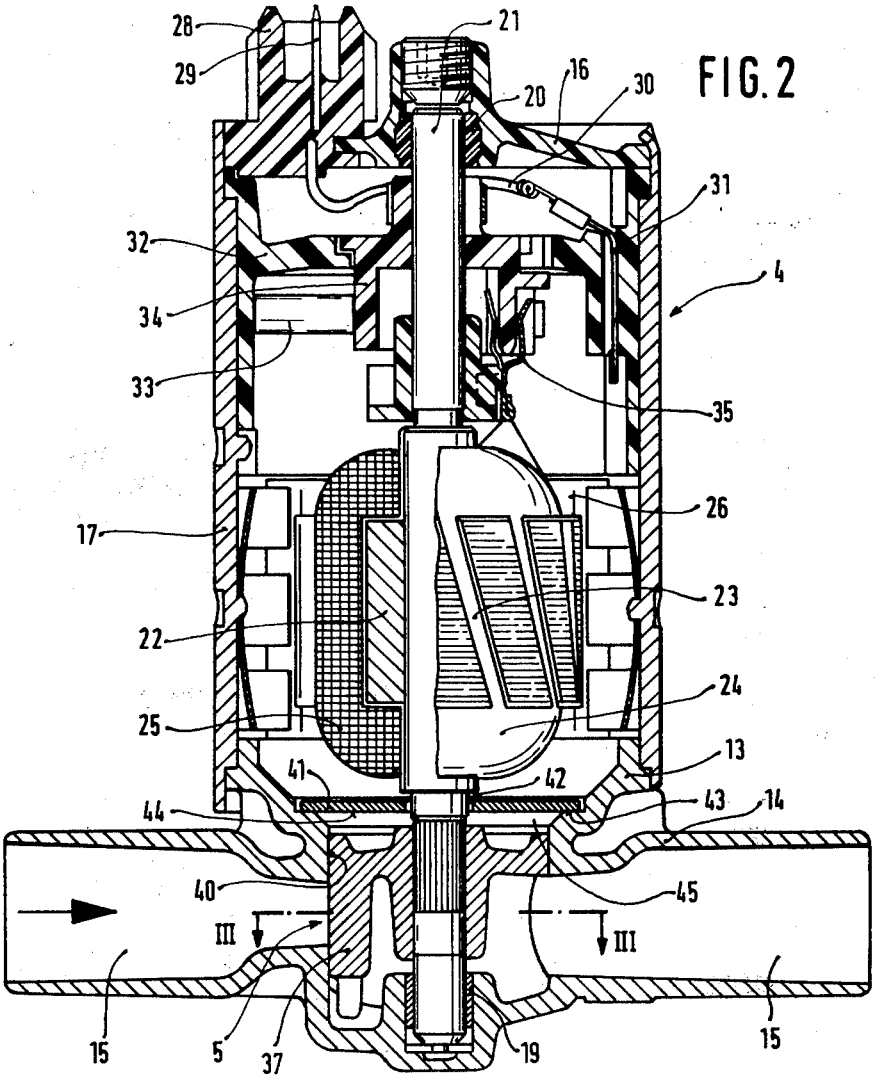
FIG. 2 is a longitudinal cross-sectional view taken through an adjustment device.
Figure 3:
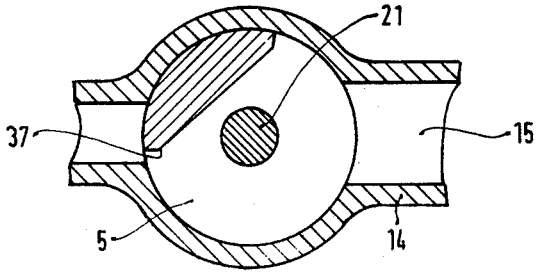
FIG. 3 is a cross-sectional view taken along the line III—III of FIG. 2.

In FIG. 2, the adjustment device 4 is shown in section. The adjustment device 4 is provided with a cap 13, which axially limits the adjustment device 4 at one end and is embodied as an integrally cast part together with a portion 14 of the bypass line 3 with the portion 14 arranged to surround the corresponding portion of the bypass 15. The other end of the adjustment device 4 remote from the cap 13 is limited by a cover cap 16. A tubular housing 17 furnishes the connection between the cap 13 and the cover cap 16. A shaft 21 is rotatably supported on one end in a slide bushing 19 in the portion 14 of the bypass line and on the other end in a slide bushing 20 in the cover cap 16. This shaft 21 is firmly connected with an armature 22 of the servomotor of the adjustment device 4. In order to cause the revisible 90° rotary movement, two coils 24, 25 are provided in the grooves 23 of the armature 22, the coils 24, 25 being displaced by 90° from one another and being wound in opposite directions. The two coils 24, 25 are triggered by the control device 6 in a known manner by direct-current pulses whose variable pulse ratios have a certain relationship to one another, so that the armature 22 assumes a position, in the magnetic field produced by two segmental permanent magnets 26, which corresponds to the pulse ratio. The adjustment device 4 is connected to an electric source by means of a flat plug 28 having three insertion prongs 29. The insertion prongs 29 are connected by strips 30 with flat plugs 31 at the circumference of an insulation carrier 32, which is guided in the housing 17 in a non-rotationally fixed manner. One flexible conductor loop 33 is connected with each of the three flat plugs 31, which are displaced relative to one another by 120° each. The conductor loops 33 each lead in a radial direction to a coil body 34 and are in electrical contact there with a fork-like contact shoe 35. The coil body 34 is firmly connected with the shaft 21. The contact shoes 35 are connected on the other end with the ends of the coils 24, 25. As a result of the cyclic triggering of the adjustment device 4, frictional resistance is reduced.

The throttle device 5, embodied as a rotary slide, is firmly connected with the shaft 21 and, with one control portion 37 each, passes with limited play through the cap 13 and the bypass 15. Depending on the position of the rotary slide 5, the control portion 37 opens the bypass 15 to a greater or lesser extent.

The interior of the housing 17 communicates with the atmosphere. Because the play between the rotary slide 5 and the bore 40 in the cap 13 or the bypass line 14 cannot be made arbitrarily small, infiltrated air flows through this area of play when the engine is in operation, as a result of the pressure drop between the atmospheric pressure in the housing 17 and the underpressure downstream of the rotary slide 5. This infiltration of air causes an undesired impairment of the control process. In order to keep this infiltrated-air component as small as possible, a sealing disc 41 having an aperture 42 is loosely guided on the shaft 21 between the armature 22 and the rotary slide 5; the diameter of the sealing disc 41 is larger than the diameter of the rotary slide 5. A sealing face 43 is machined into the cap 13 against which the sealing disc 41 can rest with its face oriented toward the rotary slide 5. Now, if during operation of the engine an underpressure prevails in the bypass portion downstream of the rotary slide 5, then this underpressure is extended, via the play between the bore 40 and the circumference of the rotary slide 5, into a chamber 45 located between the rotary slide 5 and the sealing disc 41. Thus a pressure drop prevails between the chamber 45 and the interior of the housing 17 which presses the sealing disc 41 against the sealing face 43; as a result, leakage air can enter only through the substantially smaller leakage cross section between the circumference of the shaft 21 and the aperture 42 in the sealing disc 41.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In an adjustment device for rotary angle adjustment including a housed servomotor connected via a shaft with a throttle device, said throttle device arranged to control the cross section of a bypass line bypassing a throttle valve disposed in an intake tube of an internal combustion engine, the improvement wherein said adjustment device is axially limited on one end by a cap having a bore, which is cast with a portion of said bypass line, said throttle device being embodied as a partially cylindrical rotary slide valve which passes transversely through said bore in said cap and into said bypass line, said servomotor including an armature portion, and an apertured, loosely guided sealing disc on said shaft disposed between said armature portion and said throttle valve means, said sealing disc further having a surface area arranged to be received by a sealing face of said cap upon a pressure drop at said sealing disc, whereby said servomotor is arranged to control a throttle valve means in said bypass line.

2. An adjustment device for adjusting the rotary angle of a throttle device, which controls a cross section of a bypass line bypassing a throttle valve disposed in an intake tube of an internal combustion engine, about a pivot axis which extends transversely of the bypass line, comprising:

a servomotor having a rotary portion which is connected by a shaft with the throttle device for pivotal movement about said axis;

said servomotor including an armature portion and an apertured, loosely guided sealing disc on said shaft disposed between said armature portion and said throttle valve means, said sealing disc further having a surface area arranged to be received by a sealing face of said cap upon a pressure drop at said sealing disc, and a housing for said servomotor including a cap which axially limits the adjustment device on one end and which includes a portion of said bypass line and a cylindrical axial bore extending through the cap into said bypass line portion;

wherein said throttle device is embodied as a rotary slide which is disposed in said cap bore and which includes a control portion having a partially cylindrical surface which extends transversely through said cap bore and said bypass line portion for controlling the bypass line cross section.

3. An adjustment device for adjusting the rotary angle of a throttle device, which controls a cross section of a bypass line bypassing a throttle valve disposed in an intake tube of an internal combustion engine, about a pivot axis which extends transversely of the bypass line, comprising:

a servomotor having a rotary armature which is connected by a shaft with the throttle device for pivotal movement about said axis; and a housing for said servomotor including a cap which axially limits the adjustment device on one side and which includes a portion of said bypass line and a cylindrical axial bore extending from one side of the cap oriented toward said armature into said bypass line portion, said one side of the cap including a radially-extending sealing face disposed about said cap bore; and an apertured sealing disc which is loosely guided on said shaft between said armature and said throttle device, said sealing disc having one face oriented toward said one side of the cap such that when the pressure within said housing is greater than the pressure within said cap bore, said one face of the sealing disc is pressed against said cap sealing face;

wherein said throttle device is embodied as a rotary slide which is disposed in said cap bore and which includes a control portion having a partially cylindrical surface which extends transversely through said cap bore and said bypass line portion for controlling the bypass line cross section.

* * * * *